US005114063A

United States Patent [19]

Vukelich

[11] Patent Number: 5,114,063

[45] Date of Patent: May 19, 1992

[54] WEB OR SHEET GUIDE AND CENTERING MECHANISM

[76] Inventor: John T. Vukelich, 14 Alamito La., Hot Springs Village, Ark. 71909

[21] Appl. No.: 306,522

[22] Filed: Feb. 3, 1989

[51] Int. Cl.[5] ..... B65H 17/34; B65H 23/26

[52] U.S. Cl. ..... 226/199; 226/187; 226/168

[58] Field of Search ..... 226/199, 196, 168, 180, 226/181, 186, 187, 174

[56] References Cited

U.S. PATENT DOCUMENTS

| | | | |
|---|---|---|---|
| 1,440,385 | 1/1923 | Foster | 193/1 |
| 2,726,859 | 12/1955 | Dolamore | 226/189 |
| 3,001,680 | 9/1961 | Nitkiewicz | 226/45 X |
| 3,371,770 | 3/1968 | Graham et al. . | |
| 3,392,896 | 7/1968 | Ullman | 226/187 |
| 3,643,848 | 2/1972 | Haller | 226/186 |
| 3,770,178 | 11/1973 | Olah . | |
| 3,902,648 | 9/1975 | Keyser | 226/199 |
| 4,094,452 | 6/1978 | Makela | 226/186 |
| 4,607,837 | 8/1986 | Pierce . | |

*Primary Examiner*—Daniel P. Stodola
*Assistant Examiner*—P. Bowen
*Attorney, Agent, or Firm*—Hovey, Williams, Timmons & Collins

[57] ABSTRACT

A guide apparatus for guiding a strip of material along a predetermined strip travel path and for centering the strip relative to the central axis of the travel path includes a pair of lever arms and a pair of strip engaging members spaced from one another and mounted on each of the lever arms. The lever arms are each supported for pivotal movement about a respective pivot axis centrally located between the rollers and are positioned relative to the strip travel path with the pivot axis of each lever arm extending in a direction perpendicular to a strip guiding surface and intersecting the central axis of the strip travel path. In addition, the lever arms are biased toward a pivoted position in which the strip engaging members mounted on the lever arms are adapted to engage a strip traveling along the strip travel path and center the strip relative to the central axis of the travel path.

19 Claims, 2 Drawing Sheets

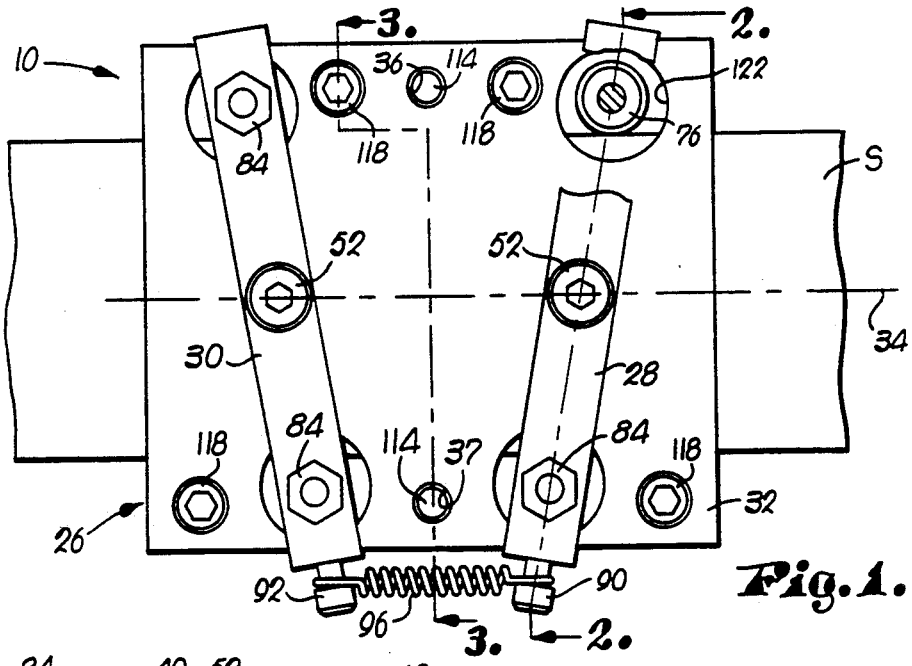
Fig.1.
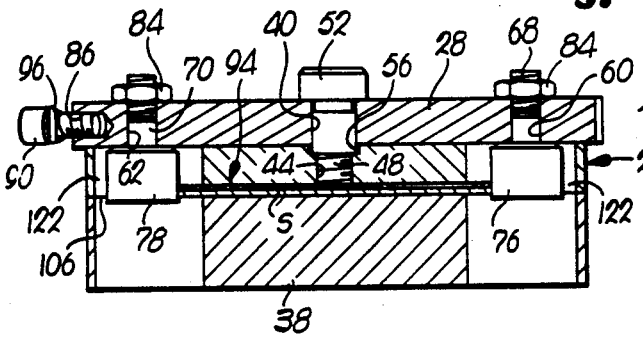
Fig.2.
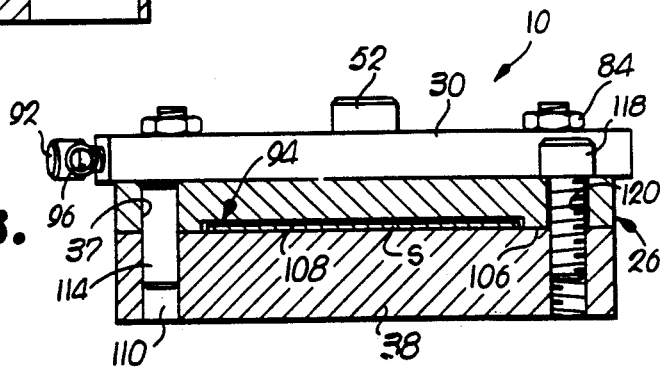
Fig.3.
Fig.5.
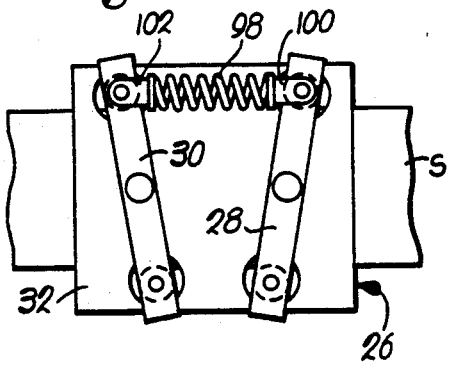
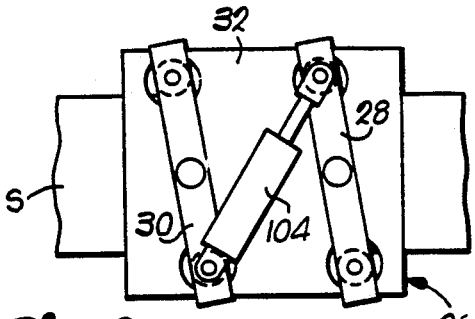
Fig.6.

WEB OR SHEET GUIDE AND CENTERING MECHANISM

BACKGROUND OF THE INVENTION

1. Field of the Invention

The present invention relates generally to sheet or web material handling devices and, more particularly, to a web and sheet guide having a centering mechanism for centering a rigid sheet or web strip of stock material relative to a processing apparatus downstream of the guide.

2. Discussion of the Prior Art

When feeding stock material to a strip processing device, such as a die set or machine, it is essential that the center line or central axis of the strip of stock material be aligned with the central axis of the die as the stock material enters the die in order to ensure that the strip is properly formed in the device. However, strip material typically used in such processing operations frequently is not perfectly straight, but rather includes a camber or uneven width along its length. This camber or uneven width in the strip is sometimes caused by cutting wheels which may wear unevenly, thus causing deformation of the material being cut due to forces exerted on the strip during cutting. Such camber in a strip is amplified when the strip is later rolled into a web.

To obviate the problems created by such camber or uneven widths along the length of strips, it is conventional to arrange a trimming device at the inlet end of the processing device and to trim the edges of a strip passing into the device to provide a center line of the strip collinear with the central axis of the desired strip travel path through the device.

Further, by guiding the strip of material into the trimming device with one edge of the strip properly aligned with a side margin of the trimming device, it is possible to reduce the amount of trimming carried out on the strip by trimming only the one unaligned edge of the strip. Thus, it is possible to save material while preserving the alignment of the strip material entering the processing device.

An example of a guide assembly capable of use in guiding a strip of material either into a trimming device or directly into a die set, is illustrated in U.S. Pat. No. 2,726,859. In the patented device, a guiding mechanism is shown as including a pair of biased rollers which bias the stock material against a backing rail aligned with the side margin of the die machine. During feeding of strip material into the die or machine, the strip is urged against the rail so that the edge of the strip in contact with the rail is aligned with the side margin of the die or machine.

Although this type of construction is useful when the strip is being fed into a trimming device prior to passing into a die set, several problems arise when the construction is employed directly in front of the die set. For example, because the guide assembly aligns an edge of the strip with a side margin of the die set rather than aligning the central axis of the strip with the central axis of the die set, the central axis of the strip may be displaced from the central axis of the die set as variations in the width of the strip occur. Thus, proper machining of the strip, which depends upon proper orientation of the centerline of the strip, is adversely affected.

In order to avoid improper alignment of a strip as it is fed into a processing machine, it has been attempted to provide an apparatus which will align the central axis of the strip with the central axis of the feed path entering the processing machine. In U.S. Pat. No. 1,440,385, a guide mechanism is illustrated in which a plurality of independently mounted and biased rollers are provided on a plate and engage the edges of the strip to position the strip for travel along a desired path.

However, numerous drawbacks exist in a construction of this type. For example, because of the large number of parts employed in such constructions, many very precise machining operations are necessary in order to provide proper cooperation between the interconnected elements. In addition, several springs are required in the apparatus which may exert uneven biasing forces on the rollers so as to cause misalignment of the rollers during a guiding operation.

OBJECT AND SUMMARY OF THE INVENTION

It is an object of the present invention to provide a guide apparatus which overcomes these shortcomings in the known mechanisms and which guides a strip of material into a die set or other known processing machine in a centered orientation relative to the center line of the desired path of strip travel.

It is another object of the invention to provide a guide mechanism capable of being easily and reliably positioned relative to a processing machine without complex readjustment of the guide apparatus so as to simplify assembly and replacement of the apparatus on the processing machine.

In accordance with the invention, a guide apparatus for guiding a strip of material along a predetermined strip travel path and for centering the strip relative to the central axis of the travel path includes a pair of lever arms and strip engaging means for engaging and guiding a strip traveling along the strip travel path. The strip engaging means includes a pair of strip engaging members spaced from one another and mounted on each of the lever arms and the lever arms are each supported for pivotal movement about a respective pivot axis centrally located between the engaging members. The inventive apparatus is also provided with positioning means for positioning the pair of lever arms relative to the strip travel path with the pivot axis of each lever arm extending in a direction perpendicular to the strip travel path and intersecting the central axis of the strip travel path. Further, lever arm biasing means bias the lever arms toward a pivoted position in which the strip engaging members mounted on the lever arms are adapted to engage a strip traveling along the strip travel path and center the strip relative to the central axis of the travel path.

Preferably, the strip engaging members are rollers rotatably mounted on the lever arms, with each roller having an axis of rotation extending in a direction parallel to the pivot axes of the lever arms. Also, the positioning means preferably includes a mounting plate on which the lever arms are pivotally mounted. The mounting plate may further include a strip receiving recess for defining the strip travel path, as well as the strip guiding surface.

The lever arm biasing means includes any one of several different biasing constructions. For example, the biasing means may include either a tension or compression spring extending between the lever arms in a direction parallel to the central axis of the travel path. Alternatively, in larger guide apparatuses, the biasing means may include a fluid actuated piston extending between the lever arms.

BRIEF DESCRIPTION OF THE DRAWING FIGURES

A detailed description of a preferred embodiment of the inventive guide apparatus is provided below with reference to the attached drawing figures, wherein:

FIG. 1 is a plan view of a guide apparatus constructed in accordance with the present invention;

FIG. 2 is a sectional view of the guide apparatus taken along line 2—2 of FIG. 1;

FIG. 3 is a further sectional view of the guide apparatus taken along line 3—3 of FIG. 1;

FIG. 5 is a plan view illustrating an alternate embodiment of the inventive guide apparatus;

FIG. 6 is a plan view of a further embodiment of the inventive guide apparatus;

DETAILED DESCRIPTION OF THE PREFERRED EMBODIMENT

Figure 7:
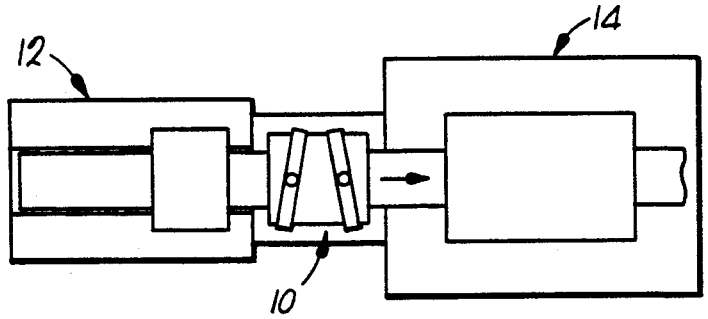
FIG. 7 is a web material processing system incorporating the inventive guide apparatus.
Figure 8:
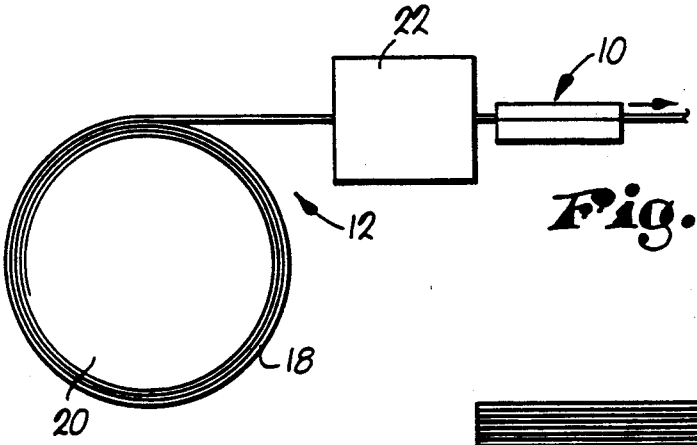
FIG. 8 is a web material feeding arrangement incorporating the inventive guide apparatus.
Figure 9:
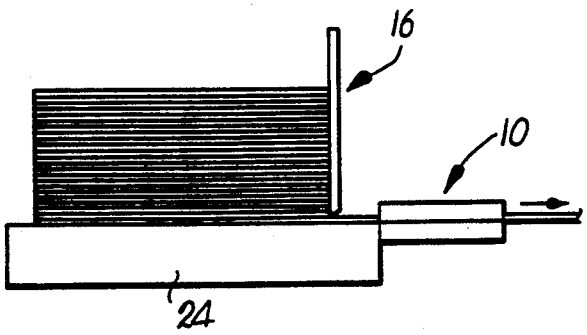
FIG. 9 is a sheet material feeding arrangement incorporating the inventive guide apparatus.

As illustrated in FIG. 7, a strip guide apparatus 10 in accordance with the present invention is employed in line with a strip feeding apparatus and a processing apparatus 14. The strip feeding apparatus may be either a web type feeding apparatus 12, as illustrated in FIGS. 7 and 8, or a sheet feeding apparatus 16 as shown in FIG. 9. In addition, the guide apparatus 10 is equally operable with feeding devices which are either intermittently or continuously operated.

The processing apparatus 14 may comprise any known processing device used for performing operations on any type of strip material having a width of between approximately ⅛ inch and 10 feet, and a thickness sufficient to withstand buckling in the widthwise direction thereof for the given width. For example, the guide apparatus 10 may be placed in-line directly in front of a die set such that no further preliminary operations are required to be carried out on the strip material prior to it entering the die set.

The feeding apparatus 12, shown in FIG. 8, preferably includes a web 18 of metal or plastic strip material supported on a support member 20. The strip material is either continuously or intermittently unwound from the web 18 and fed through the guide apparatus 10 by a feeder 22 of any known type, and is guided by the guide apparatus in a manner described below. Alternately, as shown in FIG. 9, a sheet feeder 16 may be employed which is mounted adjacent a sheet storage tray 24 and which feeds sheets from the tray through the guide apparatus 10 in the same manner as the web feeding apparatus 12 already described.

As shown in FIG. 1, the guide apparatus 10 of the preferred embodiment includes a mounting plate 26 and a pair of lever arms 28, 30 pivotally mounted on an upper surface 32 of the mounting plate 26. The mounting plate includes a center line 34 and a pair of positioning openings 36, 37 symetrically disposed on opposite sides of the center line 34 for positioning the mounting plate 26 on a support structure 38 shown in FIG. 3, in alignment with the central axis of a strip travel path extending through the apparatus.

Turning to FIG. 2, each lever arm 28, 30 is provided with a precision formed hole 40 located centrally along its length, and a threaded hole 44 is formed in the mounting plate 26 along the center line 34 of the plate for receiving the threaded portion 48 of a stripper bolt 52 extending through the hole 40 in the lever arm 28, 30. Recesses 56 are formed in the mounting plate 26 generally collinear with the threaded holes 44 and are adapted to precisely position the stripper bolts 52 and thus the pivot axes of the lever arm, along the center line 34 of the mounting plate 26.

Each lever arm 28, 30 is further provided with a pair of second openings 60, 62, and 64, 66, spaced equidistant from the pivot axis. Each of these second openings receives the partially threaded shank portions 68, 70, 72, 74 of a roller 76, 78, 80, 82 which extends downward from the lever arm 28, 30 toward the mounting plate 26 and which includes an axis of rotation extending in a direction parallel to the pivot axes of the lever arms 28, 30. A nut 84 secures each roller to the lever arm on which the roller is mounted.

End taps 86, 88 are provided in one axial end of each of the lever arms 28, 30 for receiving spring retaining elements 90, 92. As illustrated in FIG. 1, these spring retaining elements 90, 92 support a lever arm biasing means for biasing the lever arms 28, 30 toward a pivoted position in which the rollers 76, 78, 80, 82 engage a strip S traveling along the strip travel path and center the strip relative to the central axis of the travel path.

Preferably, the biasing means includes a tension spring 96 extending between the two lever arms 28, 30 in a direction parallel to the center line 34 of the mounting plate 26. However, in an alternate construction shown in FIG. 5, the tension spring 96 may be replaced by a compression spring 98 supported between the lever arms 28, 30 by spring seats 100, 102 pivotally secured to the lever arms 28, 30 at the axes of rotation of the rollers. Another alternate construction of the biasing means employed in the guide apparatus is illustrated in FIG. 6, and includes the use of a fluid actuated cylinder 104 connected between the lever arms 28, 30 to provide the desired biasing of the arms.

The recess 94 in the mounting plate 26 is provided on the lower surface 106 of the plate opposite the surface 32 on which the lever arms 28, 30 are mounted. As mentioned, this recess 94 defines the strip travel path and includes an inner surface 108 defining a strip guiding surface which extends in a plane perpendicular to the direction in which the axes of the lever arms 28, 30 extend so that the lever arms pivot in a plane parallel to the plane of the strip guiding surface. The width of the recess 94 is greater than the standard width of strip S to be guided by the apparatus 10 for permitting the strip to pass through the apparatus even if the strip has a larger width along a portion of the length thereof than along the remainder of the strip. The manner in which the strip is centered in the recess is described below.

In all of the foregoing constructions, the lever arm biasing means exerts a biasing force on each of the lever arms 28, 30 which is equal to the biasing force exerted on the other of the lever arms. By providing such biasing, it is possible to ensure that all of the rollers 76, 78, 80, 82 will exert an equal force on a strip passing through the apparatus and that the force exerted will act to center the strip S with the central axis of the strip in alignment with the center line 34 of the mounting plate 26 and the pivot axes of the lever arms 28, 30.

As shown in FIG. 3, the support structure 38 includes a pair of positioning openings 110, 112 provided in the upper surface thereof for locating the mounting plate 26 relative to the strip travel path. These openings 110, 112 align with the positioning openings 36, 37 of the mounting plate 26 when the mounting plate is properly positioned relative to the support 38 and a pair of dowels 114, 116 are slidably received in the openings 110, 36 and 112, 37 for retaining the mounting plate 26 in the proper position. Further fastening means, such as bolts 118, may be employed to secure the mounting plate 26 on the support structure once the mounting plate has been accurately positioned relative to the strip travel path. The holes 120 in the mounting plate 26 for receiving the bolts 118 are preferably slightly oversized to permit some relative movement of the mounting plate 26 relative to the support structure 38 prior to tightening of the bolts 118. By this construction, the mounting plate 26 may be accurately positioned on the support structure 38 solely by the dowels 114, 116 prior to being secured to the structure by the bolts.

Figure 4:
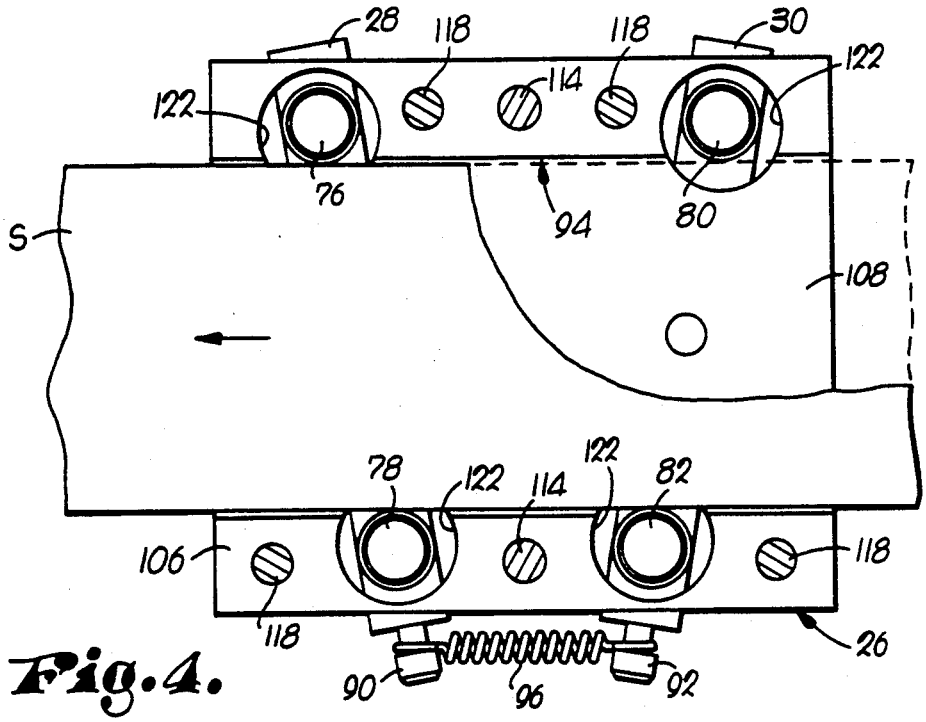
FIG. 4 is a bottom view of the guide apparatus with the strip material partially removed.

As shown in FIG. 4, the mounting plate 26 is provided with four roller receiving holes 122 which extend through the mounting plate 26 in a direction perpendicular to the plane of the strip guiding surface. Each of the holes 122 passes through the mounting plate 26 at a position partially within the recess 94 of the mounting plate so that the roller 76, 78, 80 or 82 received in the hole is able to move toward and away from the center line 34 of the mounting plate, under the biasing force of the spring 96, to engage a strip S traveling along the strip travel path. Thus, the spring 96 normally biases the lever arms 28, 30 toward a pivoted position in which the rollers mounted on the lever arms are disposed within the strip travel path.

In operation, when a strip is to be fed into the apparatus, the lever arms 28, 30 are pulled to a position laterally outward of the recess 94 by any known means, such as by the hands of the operator, and the strip is fed through the recess 94 between the support structure 38 and the mounting plate 26. Thereafter, the lever arms 28, 30 are released and the spring 96 acts on the lever arms to position the lever arms in a position in which the rollers 76, 78, 80, 82 are in engagement with the edges of the strip within the recess and exert a centering force on the strip which moves the strip to a position in which the central axis of the strip is aligned with the center line 34 of the mounting plate 26.

This centering force is created in part by the unique construction of the lever arms 28, 30 wherein the arms are located immediately over the travel path and are pivoted about pivot axes which intersect the central axis of the desired strip travel path. By employing this construction, along with rollers that are spaced on each lever arm at an equal distance from the pivot axis of the lever arm and a single spring 96 biasing the lever arms with a common biasing force, all four rollers are forced to move simultaneously toward and away from the central axis of the strip travel path by equal amounts. Thus, when any change occurs in the width of the strip passing through the device, all four rollers remain in contact with the strip, under the force of the spring 96, and retain the strip in a centered position.

Although the invention has been described with reference to the preferred embodiment, it is noted that substitutions may be made and equivalents employed herein, without departing from the scope of the invention as set forth in the following claims.

What is claimed is:

1. A guide apparatus for guiding a strip of material along a predetermined strip travel path and for centering the strip relative to the central axis of the travel path, the apparatus comprising:

a pair of lever arms;

strip engaging means for engaging and guiding a strip traveling along the strip travel path, the strip engaging means including a pair of strip engaging members spaced from one another and mounted on each of the lever arms;

means for supporting the lever arms for pivotal movement about a respective pivot axis centrally located between the strip engaging members and for positioning the pair of lever arms relative to the strip travel path with the pivot axis of each lever arm extending in a direction perpendicular to the strip travel path and intersecting the central axis of the strip travel path; and lever arm biasing means for biasing the lever arm relative to one another toward a pivoted position in which the strip engaging members mounted on the lever arms are adapted to engage a strip traveling along the strip travel path and center the strip relative to the central axis of the travel path.

2. The guide apparatus according to claim 1, wherein the strip engaging members are rollers rotatably mounted on the lever arms, each roller having an axis of rotation extending in a direction parallel to the pivot axes of the lever arms.

3. The guide apparatus according to claim 1, wherein the supporting means includes a mounting plate on which the lever arms are pivotally mounted.

4. The guide apparatus according to claim 3, wherein the mounting plate further includes a strip receiving recess for defining the strip travel path.

5. The guide apparatus according to claim 4, wherein the mounting plate includes a plurality of holes extending through the mounting plate into the strip receiving recess, the holes being adapted to receive the strip engaging means and to permit the strip engaging means to center the strip traveling within the strip receiving recess relative to the central axis of the strip travel path.

6. The guide apparatus according to claim 5, wherein the strip engaging members are rollers mounted on the lever arms, each roller having an axis of rotation extending in a direction parallel to the pivot axes of the lever arms.

7. The guide apparatus according to claim 1, wherein the lever arm biasing means includes a spring extending between the lever arms.

8. The guide apparatus according to claim 7, wherein the spring is a tension spring.

9. The guide apparatus according to claim 7, wherein the spring is a compression spring.

10. The guide apparatus according to claim 1, wherein the lever arm biasing means includes a fluid actuated piston extending between the lever arms.

11. The guide apparatus according to claim 1, wherein the lever arm biasing means exerts a biasing force on each of the lever arms which is equal to the biasing force exerted on the other of the lever arms.

12. A guide apparatus for guiding a strip of material along a predetermined strip travel path and for centering the strip relative to the central axis of the travel path, the apparatus comprising:

a pair of lever arms each having a pair of guide rollers mounted thereon which are spaced from one another;

means for supporting the lever arms for pivotal movement about a respective pivot axis centrally located between the rollers;

positioning means including a strip guiding surface for positioning the pair of lever arms relative to the strip travel path with the pivot axis of each lever arm extending in a direction perpendicular to the plane of the strip guiding surface and intersecting the central axis of the strip travel path; and lever arm biasing means for biasing the lever arms toward a pivoted position in which the rollers mounted on the lever arms are disposed within the strip travel path, the biasing means being adapted to cause the rollers to engage a strip traveling along the strip travel path and center the strip relative to the central axis of the travel path.

13. The guide apparatus according to claim 12 wherein the positioning means includes a mounting plate on which the lever arms are pivotally mounted.

14. The guide apparatus according to claim 13, wherein the mounting plate further includes a strip receiving recess for defining the strip travel path and the strip guiding surface.

15. The guide apparatus according to claim 12, wherein the lever arm biasing means includes a spring extending between the lever arms.

16. The guide apparatus according to claim 15, wherein the spring is a tension spring.

17. The guide apparatus according to claim 15, wherein the spring is a compression spring.

18. The guide apparatus according to claim 12, wherein the lever arm biasing means includes a fluid actuated piston extending between the lever arms.

19. The guide apparatus according to claim 12, wherein the lever arm biasing means exerts a biasing force on each of the lever arms which is equal to the biasing force exerted on the other of the lever arms.

* * * * *